US007625605B2

(12) United States Patent
Cooprider et al.

(10) Patent No.: US 7,625,605 B2
(45) Date of Patent: Dec. 1, 2009

(54) METHOD FOR COATING A SURFACE WITH A PATTERN OF COATING FLUID

(75) Inventors: Terrence E. Cooprider, Woodbury, MN (US); Laura M. Rider, Bronaugh, MO (US); Ronald W. Most, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 713 days.

(21) Appl. No.: 11/027,542

(22) Filed: Dec. 30, 2004

(65) Prior Publication Data

US 2006/0147637 A1 Jul. 6, 2006

(51) Int. Cl.
*B05D 1/28* (2006.01)

(52) U.S. Cl. ..... 427/286; 427/288; 427/428.06; 427/428.11

(58) Field of Classification Search ..... None
See application file for complete search history.

(56) References Cited

U.S. PATENT DOCUMENTS

| | | | | |
|---|---|---|---|---|
| 3,552,353 | A | 1/1971 | Labombarde | |
| 3,691,140 | A | 9/1972 | Silver | |
| 3,857,731 | A | 12/1974 | Merrill, Jr. et al. | |
| 3,897,578 | A | 7/1975 | Kanda et al. | |
| 4,166,152 | A | 8/1979 | Baker et al. | |
| 4,268,597 | A * | 5/1981 | Klavan et al. | 430/102 |
| 4,404,243 | A * | 9/1983 | Terpay | 428/62 |
| 4,468,418 | A * | 8/1984 | Freeman et al. | 427/208.2 |
| 4,477,309 | A * | 10/1984 | Chudy et al. | 216/55 |
| 4,495,318 | A | 1/1985 | Howard | |
| 4,839,416 | A * | 6/1989 | Orenstein et al. | 524/558 |

(Continued)

FOREIGN PATENT DOCUMENTS

| | | |
|---|---|---|
| DE | 39 27 365 | 8/1989 |

(Continued)

OTHER PUBLICATIONS

Herbert L. Weiss, "Coating and Laminating Machines," pp. 168-173 (1989).

(Continued)

*Primary Examiner*—Frederick J Parker
(74) *Attorney, Agent, or Firm*—Robert H. Jordan

(57) ABSTRACT

A method of defining a pattern of coating fluid on a surface includes introducing coating fluid containing microspheres onto a surface of an applicator roll, wherein the topography of the applicator roll surface comprises at least one longitudinally extending circumferential, helical groove portion which is sized to at least partially receive the microspheres of the coating fluid therein, and at least one circumferential, longitudinally extending smooth surface portion. The method further includes engaging the applicator roll surface with a doctor blade to remove coating fluid from the smooth surface portions thereof and to limit the amount of microspheres advanced past the doctor blade by the helical groove portion of the applicator roll surface. Thus, a pattern of coating fluid containing microspheres remains on the applicator roll surface which is defined by the helical groove portion thereon and is formed to define at least one stripe of coating fluid containing microspheres. The pattern of coating fluid is transferred from the applicator roll surface to a moving web by a reverse kiss coating.

25 Claims, 11 Drawing Sheets

U.S. PATENT DOCUMENTS

| | | | | |
|---|---|---|---|---|
| 5,045,569 | A | 9/1991 | Delgado | |
| 5,340,611 | A | 8/1994 | Kustermann et al. | |
| 5,447,747 | A | 9/1995 | Munter et al. | |
| 5,571,617 | A | 11/1996 | Cooprider et al. | |
| 5,714,237 | A | 2/1998 | Cooprider et al. | |
| 5,756,625 | A | 5/1998 | Crandall et al. | |
| 5,811,157 | A | 9/1998 | Kurtz et al. | |
| 5,824,748 | A | 10/1998 | Kesti et al. | |
| 5,916,630 | A | 6/1999 | Le Riche et al. | |
| 6,296,932 | B1 | 10/2001 | Crandall et al. | |
| 6,531,027 | B1 * | 3/2003 | Lender et al. | 156/291 |
| 6,692,819 | B1 * | 2/2004 | Castle et al. | 428/211.1 |
| 2003/0109630 | A1 * | 6/2003 | Smith et al. | 524/533 |

FOREIGN PATENT DOCUMENTS

| | | |
|---|---|---|
| EP | 0 431 336 | 6/1991 |
| EP | 0 847 308 | 1/2000 |
| WO | WO 97/07899 | 3/1997 |

OTHER PUBLICATIONS

Emerson & Renwick Ltd., England: two sheets entitled "Converting Dixon Expertise—Stripe Coating" and one sheet entitled "Converting Dixon Expertise—3 Roll Reverse-Stripe Coating" (available prior to Dec. 30, 2004).

U.S. Appl. No. 11/027,511; Cooprider, Terrence E., et al.; filed Dec. 30, 2004; and total pages with drawings is 37 pages.

* cited by examiner

METHOD FOR COATING A SURFACE WITH A PATTERN OF COATING FLUID

BACKGROUND OF THE INVENTION

This application relates to a method for applying a coating fluid. More particularly, the present invention relates to applying coating fluid in a specifically desired longitudinally disposed pattern.

In various product designs, it is desirable to coat one or more stripes of a coating material in a down-web or cross web pattern on a substrate such as a moving paper web or polymeric film web. In some applications, the coating material comprises a pressure sensitive adhesive (either permanent or removable). In particular, such adhesives may constitute pressure sensitive adhesive coatings including microsphere based adhesives, such as those disclosed in U.S. Pat. Nos. 6,296,932, 5,824,748, 5,756,625, 5,714,237, 5,571,617, 5,045,569, 4,495,318, 4,166,152, 3,857,731, and 3,691,140. It is important when processing such microsphere based adhesives that the relatively delicate microspheres themselves not be damaged or ruptured. For example, if the microspheres are cut or sheared, the adhesive materials therein could start to agglomerate, thereby making it difficult to handle the coating material and form a uniform layer thereof on a substrate. Such agglomeration also may cause the adhesive material to adhere to components of the coating equipment or further web processing equipment, thereby necessitating a shut down of the coating process while coating equipment and components are cleaned.

Accordingly, it is quite important that microsphere adhesives be handled delicately in processing and that any shearing of those adhesives in fluid form be done in a manner that would minimize possible shearing of the microspheres themselves. This goal has proved problematic in many processing conditions where metering and further processing of a microsphere adhesive based coating requires such activities as dispensing of the coating through a die under pressure, exposure of the coating to a doctor blade on a roller, or metering under pressure, exposure of the coating to a doctor blade on a roller, or metering of the coating by passing it through a nip between opposed rollers. For instance, if there is insufficient space in a nip between opposed rolls for a microsphere to pass through that nip, it cannot do so. The microspheres are then squeezed out to the sides of the roll and do not accumulate on any coating being deposited after the nip The deficiencies in prior art processes include inadequate transfer of adhesive from an etched gravure application roll to the web, or undue splitting of the coating material in film form during flexographic coating. In addition, the shear sensitivity and/or poor rheological properties of the microsphere adhesive fluid may result in excessive coagulation (i.e., caused by agglomeration of sheared adhesive microspheres) and/or non-uniform coating lay down, which will result in non-uniform streaks of adhesive, mottled adhesive patterns, coating voids or an undesired "orange peel" coating effect which affect the adhesion level of the dried coating.

BRIEF SUMMARY OF THE INVENTION

The present invention is a method of defining a pattern of coating fluid on a surface which comprises introducing coating fluid containing microspheres onto a surface of an applicator roll. The topography of the applicator roll surface comprises at least one longitudinally extending circumferential, helical groove portion which is sized to at least partially receive the microspheres of the coating fluid therein, and at least one circumferential, longitudinally extending smooth surface portion. The method further comprises engaging the applicator roll surface with a doctor blade to remove coating fluid from the smooth surface portion thereof and to limit the amount of microspheres advanced past the doctor blade by the helical groove portion of the applicator roll surface, wherein a pattern of coating fluid containing microspheres remains on the applicator roll surface which is defined by the helical groove portion thereon and is formed to define at least one stripe of coating fluid containing microspheres.

The above summary of the present invention is not intended to describe each disclosed embodiment or every implementation of the present invention. The figures and the detailed description which follow more particularly exemplify illustrative embodiments.

BRIEF DESCRIPTION OF THE DRAWINGS

The present invention will be further explained with reference to the drawing figures listed below, where like structure is referenced by like numerals throughout the several views.

While the above identified figures set forth several embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

Applicants have discovered and developed a unique apparatus and process for selectively applying a down-web pattern of coating fluid onto a moving web. This pattern, in its simplest form, may comprise a single stripe of coating fluid deposited on the moving web or a plurality of parallel stripes applied along the length of the moving web. In addition, the pattern can be continuously applied to the moving web (i.e., a continuous stripe or plurality of stripes of coating fluid), or the application of the pattern can be stopped all together even though the web continues to move past the inventive coating apparatus. In addition, the apparatus can be configured to apply an intermittent pattern of coating fluid to the web (i.e., a discontinuous strip of coating fluid applied along the length of the moving web, such as "dashes" or blocks of coating fluid).

Alternative methods and apparatus for achieving these ends are disclosed herein. In each instance, the coating fluid is handled in a manner which does not create excessive shear forces acting upon the coating fluid that would otherwise damage components of the coating fluid (e.g., microspheres of adhesive material) and lead to non-uniform applications thereof.

Figure 1:
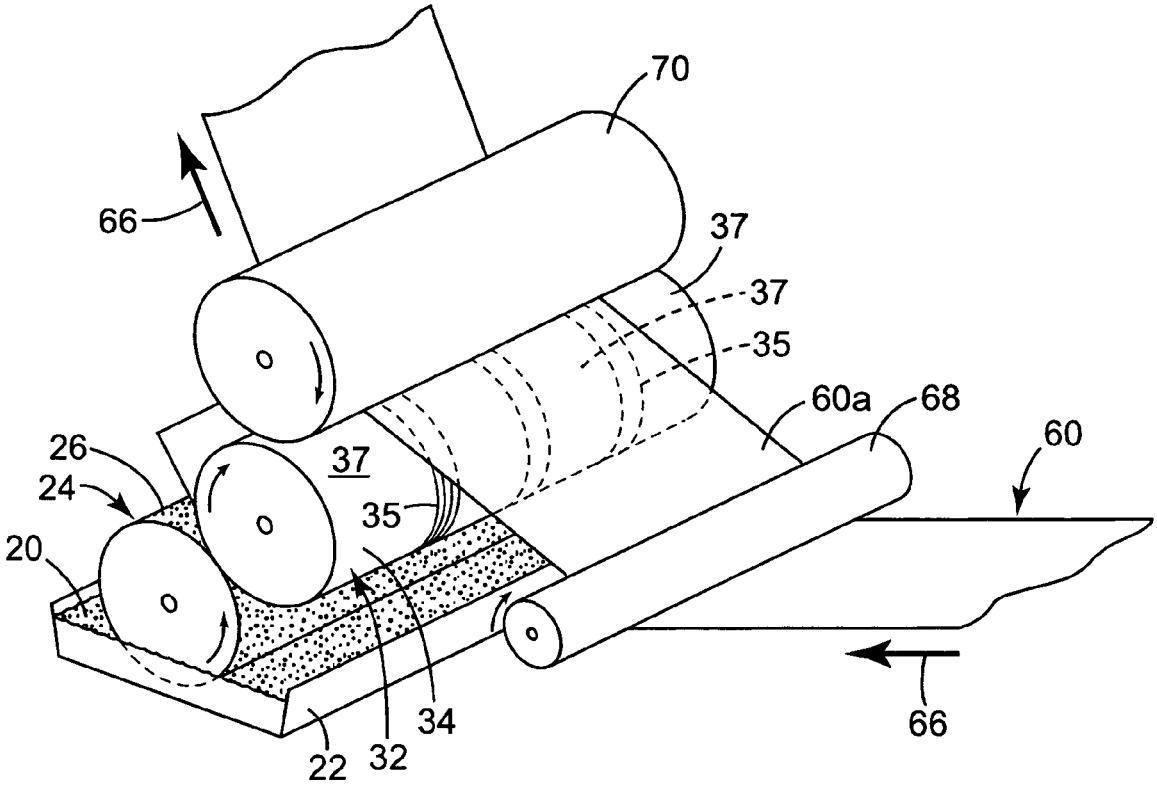
FIG. 1 is a perspective view of a web coating apparatus of the present invention having a grooved coating fluid applicator roll.
Figure 2:
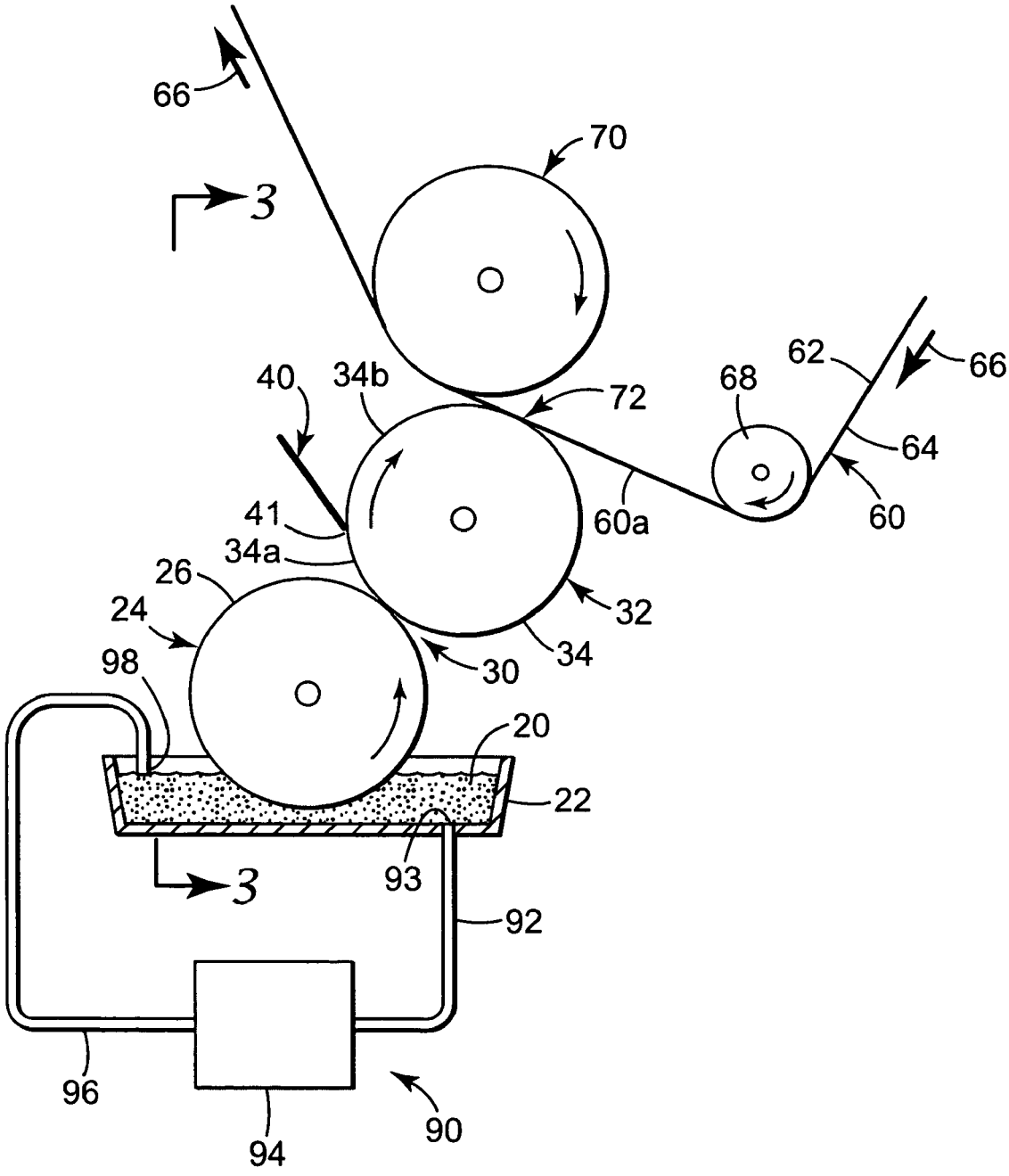
FIG. 2 is a schematic side view of the inventive coating apparatus of the present invention, further illustrating a coating fluid recycling and consistency management system.
Figure 3:
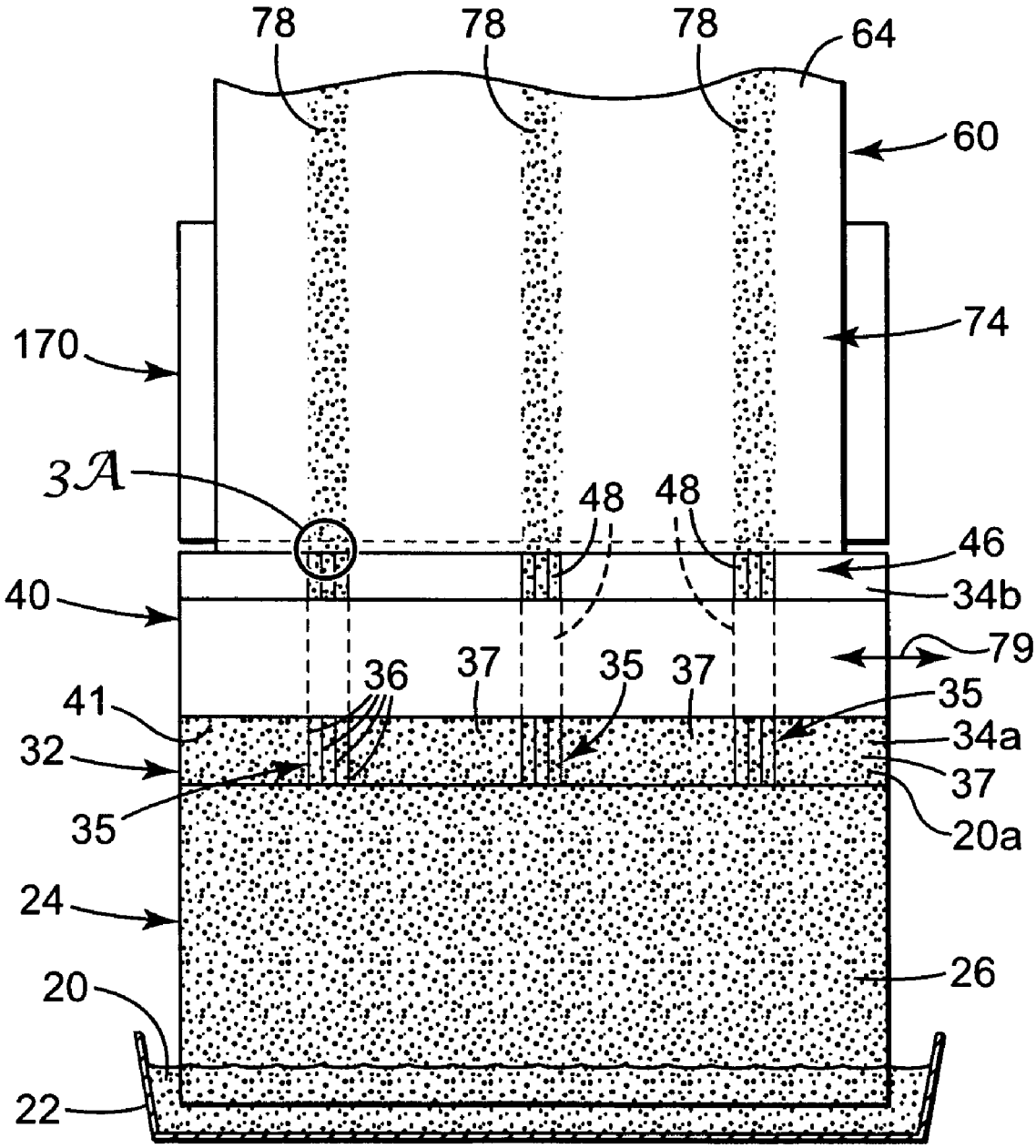
FIG. 3 is a schematic sectional view as taken along lines 3-3 in FIG. 2, showing the grooved applicator roll and doctor blade.

FIGS. 1, 2 and 3 illustrate schematically an apparatus and process for defining a coating fluid pattern and selectively applying that pattern to a moving web. Coating fluid 20 is supplied from a pan 22 or other suitable supply means (such as an enclosed doctor blade system) to a rotating fountain roll 24. The coating fluid 20 is picked up by a moving surface 26 of the fountain roll 24 and carried into a nip 30 (see FIG. 2) defined between the fountain roll 24 and a parallel rotating applicator roll 32. As seen in FIGS. 1 and 3, the applicator roll 32 has a circumferential surface 34 which includes one or more longitudinally extending circumferential, helical groove portions 35 thereon. Each groove portion 35 extends completely around the applicator roll surface 34 and is defined by a helical groove 36 (see FIG. 3A), and those portions of the applicator roll surface 34 which are not groove portions 35 are formed as circumferential, longitudinally extending smooth surface portions 37. At the nip 30, coating fluid is transferred from the fountain roll surface 26 to the applicator roll surface 34. The fountain roll 24 and applicator roll 32 are rotated so that their respective surfaces 26 and 34 move toward the nip 30, and are aligned with a slight gap (e.g., from 2 mil to about 10 mil) between the surfaces at the nip 30.

As seen in FIG. 3, a layer of coating fluid 20*a* is borne on a post-nip applicator roll surface 34*a* and is generally uniformly disposed across the entire operative area of that surface 34*a*. Also in FIG. 3, the topography of the applicator roll surface 34 is illustrated as comprising three groove portions 35, which thus serve to define the desired coating fluid transfer topography (e.g., with each groove portion 35 formed from a helical groove 36); however, a single groove portion or any plurality of spaced groove portions may provide the desired topography for coating fluid transfer (and coating fluid stripe formation).

A doctor blade 40 engages the post-nip applicator roll surface 34*a*, as seen in FIGS. 2 and 3. The doctor blade 40 is a reverse doctor blade having linear operative scraping edge 41 which engages the applicator roll surface 34*a*. The doctor blade 40 effectively scrapes the coating fluid 20*a* off the applicator roll surface 34 except for the groove portions 35. In other words, the coating fluid 20*a* is scraped off of each smooth portion 37 of the applicator roll surface 34. The helical grooves 36 in the groove portions 35 in each groove portion 35 allow some coating fluid to remain on the applicator roll 32 by passing under the operative scraping edge 41 of the doctor blade 40. Coating fluid which is allowed to remain on the applicator roll surface 34 after it passes the doctor blade 40 thus only resides within the groove portions 35 thereof. The groove portions 35 themselves define a pattern 46 of coating fluid 20*a* remaining on the applicator roll 32, and specifically on the post-doctor blade applicator roll surface 34*b*. As illustrated in FIG. 3, each groove portion 35 defines a stripe 48 of metered coating fluid 20*a* remaining on the surface 34 of the applicator roll 32 as it moves beyond the doctor blade 40. In addition to scraping coating fluid off of the smooth portions 37 of the applicator roll surface 34, the edge 41 of the doctor blade also serves a metering function relative to the groove portions 35, only allowing coating fluid to pass under the doctor blade within the groove 36 of each groove portion 35.

In FIG. 2, a web 60 (such as a paper sheeting or polymeric sheeting) having a top surface 62 and an opposed coating surface 64 is moved past the applicator roll 32, in direction of arrows 66. The web 60 is moved in an opposite direction from the direction of movement of the applicator roll surface 32. The path that the web 60 traverses adjacent to the applicator roll 32 is defined in part by an idler roll 68 and an impression roll 70. As seen in FIG. 2, the web 60 contacts the applicator roll 32 along a free span 60*a* without any support on the top surface 62 of the web 60 opposite a line of contact between the surface 34 of the applicator roll 32 and the web 60. At this line of contact (indicated as at 72 in FIG. 2) the coating fluid pattern 46 on the post-doctor blade applicator roll surface 34*b* is transferred onto the coating surface 64 of the web 60 in a corresponding pattern 74 of coating fluid (see FIG. 3). The pattern 74 on the web 60 includes a stripe of coating fluid 78 corresponding to each stripe 48 borne on the applicator roll 32. Each stripe 78 has generally linear side edges and a uniform coat weight, from side to side and along the length of the stripe 78. The relative smoothness of the stripe 78 improves as the roughness of the web coating surface 64 increases. After the coating fluid is so applied, the coated web 60 is then advanced to a drying or curing station for the coating fluid thereon, and then to further processing or converting stations along its web path. The contact between the web and the applicator roll surface is thus defined as a reverse kiss for purposes of coating fluid transfer.

In one embodiment, the line of contact 72 may constitute a line having a width (as measured in direction of web travel) of about 0.125 inch to about 0.25 inch. As seen in FIG. 2, there is a short span of web 60 between the line of contact 72 (the reverse kiss contact between the applicator roll surface 34 and the coating surface 64 of the web 60) and the line of contact of the top surface 62 of the web 60 with the impression roll 70. This reverse kiss coating arrangement is disclosed in EP 0847308. As opposed to a larger span distance, this short span assures greater web stability during the transfer of the coating fluid to the web, which in turn yields improved down-web and cross-web uniformity of coating fluid transfer and application characteristics such as coat weight.

In addition, one means for establishing a desired coating weight for the coating fluid transferred onto the web 60 is by having the web 60 traverse the applicator roll line of contact 72 at a speed different then the speed of the applicator roll surface 34. The applicator roll surface 34 may be moved at a speed 0-40% faster than the coating surface 64 of the web 60, although in one embodiment, a 20% overspeed relationship has proved satisfactory. Transfer rates of coating fluid from the applicator roll to the web ranging from about 30% to about 70% have been observed, although in one embodiment, 60% transfer rate has proved satisfactory. The fountain roll surface 26 is advanced at about the same surface speed as the applicator roll surface 34. Thus, both surfaces of the fountain roll and applicator roll can move at about the same speed relative to one another through the nip 30. In an alternative embodiment, the fountain roll surface may be moved at a slower speed than the applicator roll surface speed, as a means of reducing foaming effects in the coating fluid.

In the fluid coating system illustrated in FIGS. 1-3A and described above, initial metering of the coating fluid to the stripes 48 on the applicator roll 32 is a function of the topography of the applicator roll surface 34 and the passing of that topography under the doctor blade 40. The metered coating fluid thus assumes the shape of the desired pattern 46. This pattern is then transferred from the applicator roll 32 in a reverse kiss coating operation onto the coating surface 64 of the web 60 as pattern 74 of coating fluid.

Figure 3A:
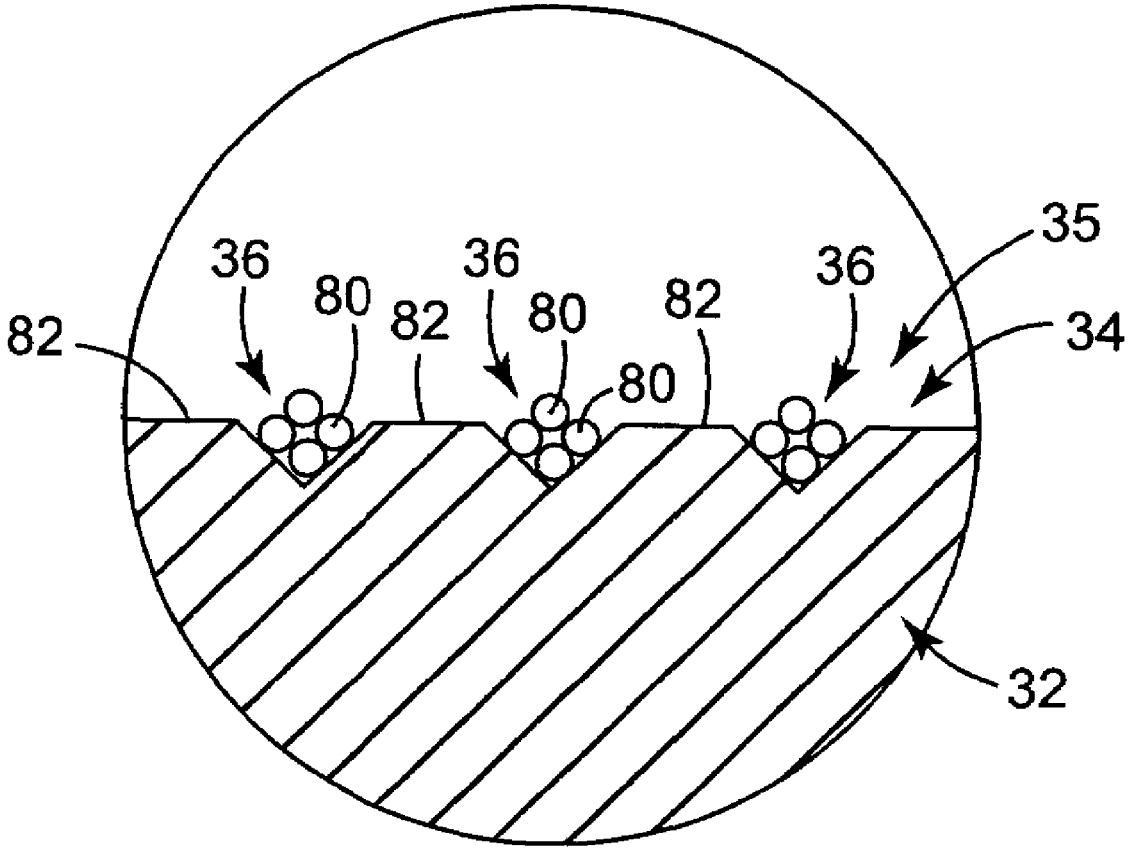
FIG. 3A is an enlarged sectional view of a helically grooved surface of an applicator roll adapted for use in the coating system of the present invention.

A coating fluid particularly adapted for use in connection with the inventive coating system is a microsphere based adhesive. Such an adhesive may have microspheres having an average diameter ranging from about 5 microns to about 200 microns. An adhesive having microspheres having an average diameter of about 40 microns is typical. Microsphere based adhesives for which the inventive coating system is believed applicable include those disclosed in U.S. Pat. Nos. 6,296,932 and 5,571,617. In these adhesive materials, adhesive microspheres are suspended in an aqueous solution which may include other additives to achieve desired fluid or adhesive characteristics. As illustrated in FIG. 3A, the helical groove 36 formed in the applicator roll surface 34 of the applicator roll 32 is sized to at least partially accept one or more microspheres 80 therein. The groove 36 shown in FIG. 3A is a V-shaped groove, but other groove shapes will suffice (e.g., a U-shaped groove), so long as the groove is deep enough to accept one or more microspheres therein. The groove may have a depth of about 50 microns to about 300 microns, and, for a V-shaped groove, a tooth angle of about 15 degrees to about 120 degrees (or in some embodiments a tooth angle of about 60 degrees to about 90 degrees may be preferred). The groove may be disposed at about 40 grooves per inch to about 300 grooves per inch, as measured longitudinally (in an axial dimension) across the applicator roll surface 34 (in some embodiments, about 60 grooves per inch to about 150 grooves per inch may be preferred). As seen in FIG. 3A, a land 82 is provided between adjacent portions of each helical groove 36. In one embodiment, the helical groove 36 has a depth of 100 microns, with an opening width of 205 microns, and the land 80 has a width of 113 microns between adjacent portions of the helical groove 36. The helical groove 36 is aligned at an angle of about 80 degrees to about 90 degrees relative to an axis of the applicator roll 32. In one embodiment, the helical groove is aligned at nearly 90 degrees relative to that axis (e.g., 89.95 degrees).

The applicator roll surface may have an alternative surface topography (other than a helical groove), so long as the surface topography includes surface features deep enough to permit passage of one or more microspheres therein under the operative scraping edge of the doctor blade without damaging the microspheres. For example, the surface topography may comprise a plurality of annular, parallel grooves on the applicator roll surface to serve the metering function. Likewise, the surface topography may comprise a plurality of cells (e.g., in a screen pattern) on the applicator roll surface for establishing the metering function of the microsphere adhesive coating fluid.

The fountain roll surface is smooth to carry coating fluid uniformly to the applicator roll surface. The fountain roll surface may be hard (i.e., non-conformable) or may be formed of a conformable material such as urethane rubber. Other exemplary materials suitable for forming the fountain roll surface include stainless steel, chrome plated steel, hard plastics and polished ceramics.

The applicator roll surface is hard (i.e., non-conformable), and in one embodiment is a chrome plated roll surface of a steel roll. Other exemplary suitable materials for the applicator roll surface include stainless steel, hard plastics and polished ceramics. As explained above, the pattern 46 of coating fluid disposed on the post-doctor blade applicator roll surface 34*b* is defined by the groove portions 35 in the applicator roll surface 34. In FIG. 3, three groove portions 35 of equal size are illustrated, which thereby define three equally wide stripes of coating fluid containing microspheres on the post-doctor blade applicator roll surface 34*b*. Those smooth portions 37 of the post-doctor blade applicator roll surface 34*b* have been scraped clear of coating fluid by the operative edge 41 of the doctor blade 40 (while some small amount of the aqueous solution of a microsphere based adhesive may remain on the smooth portions 37, no microspheres are present). The coating fluid 20*a* scraped off the applicator roll surface 34 thus runs back onto the fountain roll surface 26 and is carried back into the pan 22.

The coating fluid pattern 46 can be modified by replacing the applicator roll 32 with an alternative applicator roll having a different alignment of groove portions thereon. Such an alternative applicator roll may have only a single groove portion, or any number of spaced apart groove portions. In addition, those groove portions may be of like size (i.e., width) or of different widths on the same applicator roll. As can be appreciated, any desired pattern of groove portions can be formed on the applicator roll surface which, after passage by the doctor blade, will accordingly define a desired pattern of coating fluid on the applicator roll surface (and ultimately on the web).

As noted above, the coating fluid is metered for application to the web 60 by passage through the groove portions 35 under the doctor blade 40. The operative scraping edge 41 of the doctor blade extends across the applicator roll surface 34, contacting the smooth portions 37 thereof and lands 82 thereon (FIGS. 3 and 3A). The surface features and the topography of the applicator roll 32 (e.g., grooves 36 in groove portions 35) are sufficiently deep to permit passage of one or more microspheres 80 therein under the edge 41 of the doctor blade 40. This relationship defines a specific means for metering the number of microspheres 80 which are able to pass the doctor blade 40, and thus defines the amount of coating fluid containing microspheres present in the stripes 48 on the applicator roll surface 34*b*. In addition, the microspheres 80 passing under the edge 41 via the surface topography are not damaged or sheared as they pass (although some microsphere compression may occur). The grooves (or other suitable topography features) allow the microspheres to essentially "line up" for passage past the doctor blade and because of the relative size of the grooves and microspheres, only so many microspheres may pass through over time as the applicator roll rotates past the doctor blade. For this arrangement, precise metering of the amount of microspheres on the post-doctor blade applicator roll surface 34*b* is thus obtained, which leads to a uniformed deposition of adhesive on the web 60 once the adhesive is transferred from the applicator roll 32 to the web 60.

The doctor blade (or at least its operative edge) is formed from a stiff material which is aligned to scrape against the hard applicator roll surface 34. Such exemplary materials include stainless steel, polyester, ceramic coated materials and composite materials. To minimize possible scoring of the doctor blade by edges of the grooves 36 in the groove portions 35, the doctor blade may be reciprocated in direction of arrows 79, as illustrated in FIG. 3, so that it moves back and forth across the applicator roll surface while retaining its operative edge in contact therewith.

FIG. 2 includes a schematic illustration of a recycling and replenishment system 90 for the coating fluid 20. A drain conduit 92 extends from an opening 93 in the pan 22 to a replenishment tank assembly 94. The tank assembly 94 has means for receiving additional coating fluid to replenish the coating fluid which has been applied by the coating fluid application system to the web 60. The tank assembly 94 includes a pump for pumping coating fluid 20 through an inlet conduit 96 to an outlet 98 for delivering coating fluid 20 back to the pan 22. The tank assembly 94 may also include means for monitoring the viscosity of the coating fluid 20. When the coating fluid 20 comprises microspheres borne in an aqueous solution, a "dewatering" naturally occurs in part because of evaporation of the aqueous solution. Also, the coating fluid scraped off the applicator roll leaves a thin film of water (i.e., aqueous solution) on the surface of the applicator roll, thus dewatering the coating fluid. In addition, because the metering achieved by the grooves and doctor blade allows a lower percentage of solids (i.e., microspheres) to be transferred from the applicator roll to the web than an unmetered transfer would allow, the solidity (and viscosity) of the adhesive being scraped off the applicator roll and returned to the pan for reuse is elevated. The viscosity of the adhesive being delivered to the pan 22 is monitored, and if necessary because of dewatering, additional aqueous solution is added to maintain a desired viscosity level. In one embodiment, the viscosity monitoring and adjustment function is handled by an Inkspec Junior viscosity control system, available from Peripheral Advanced Design, Inc., Boucherville, Quebec, Canada. While only shown with respect to FIG. 2, it is understood that a coating fluid recycling and replenishment system 90 to perform the functions described above may be provided for any embodiment of the inventive coating application system.

Figure 4:
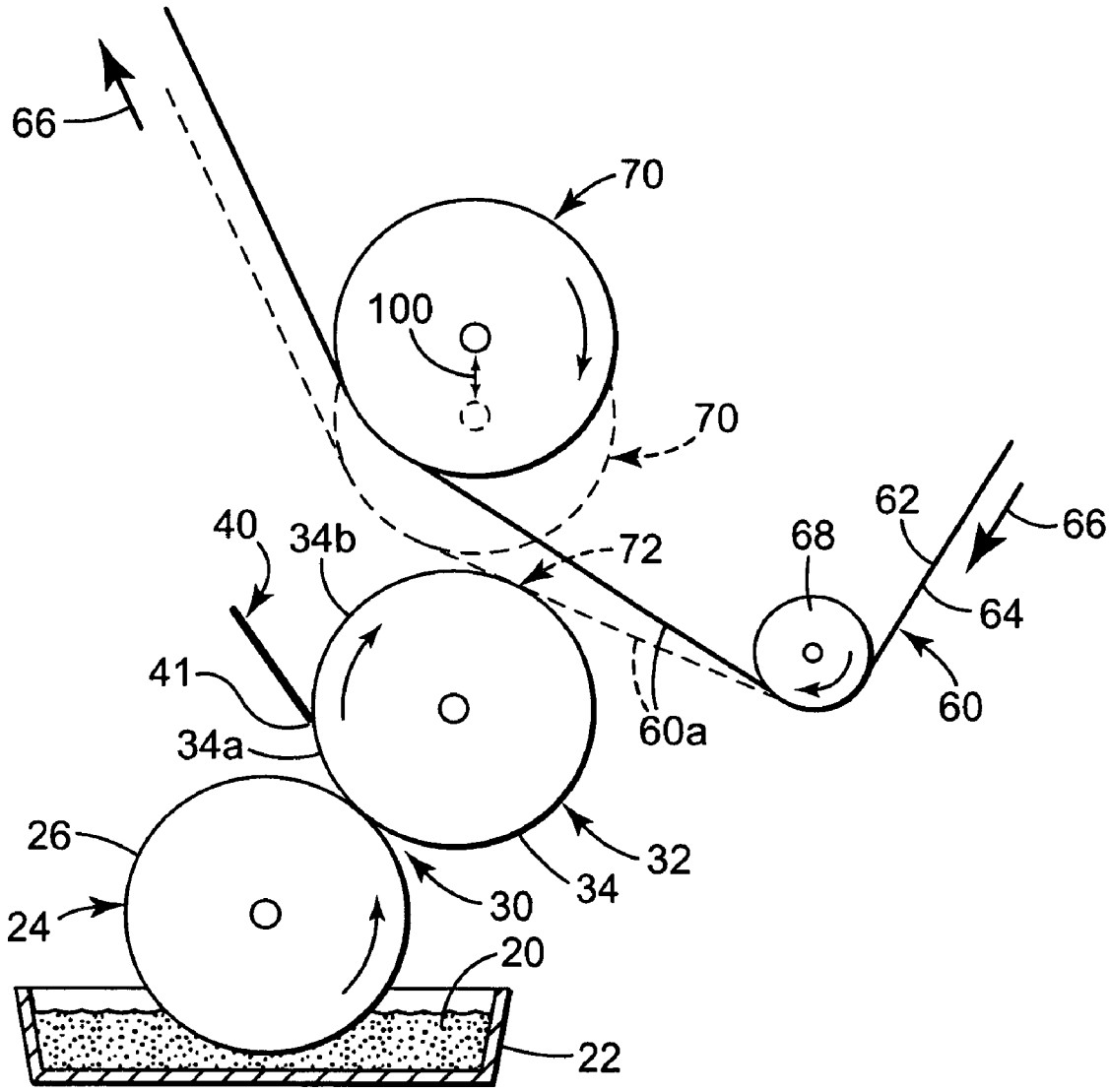
FIG. 4 is a schematic side view of the coating apparatus of FIG. 2, showing an impression roll moved to a position wherein a moving web is not in contact with the applicator roll.

As noted above, the coating surface 64 of the web 60 picks up the coating fluid along the line of contact 72 with the post-doctor blade applicator roll surface 34*b*. With the inventive coating system, however, it is quite easy to turn the process "off" with respect to the moving web 60 by simply disengaging the coating surface 64 of the web 60 with the applicator roll surface 34. This is accomplished, in one embodiment, by moving the rotating impression roll 70 away from the applicator roll 32. FIG. 4 illustrates (in solid lines) the applicator roll 70 moved a sufficient distance away from the applicator roll 32 to separate the web 60 from the applicator roll surface 34. The free span 60*a* of the moving web 60 thus follows a path that does not engage the applicator roll surface 34 at any line of contact, thereby not enabling a transfer of coating fluid from the applicator roll 32 to the web 60. When in this separated configuration, the stripes 48 of coating fluid on the applicator roll surface 34 stay on the applicator roll surface 34 and reenter the nip 30 as the applicator roll 32 rotates. When it is desired to turn the coating process "on" the impression roll 70 is moved toward the applicator roll 32 (as shown in phantom in FIG. 4) until the free span 60*a* again contacts the post-doctor blade applicator roll surface 34*b* at the line of contact 72, thereby initiating the transfer of coating fluid by a reverse kiss transfer onto the coating surface 64 of the web 60 in the desired coating fluid pattern 74. As illustrated in FIG. 4, movement of the impression roll 70 in direction of arrows 100 is effective to turn "off" and "on" the coating process relative to the web 60.

Figure 5:
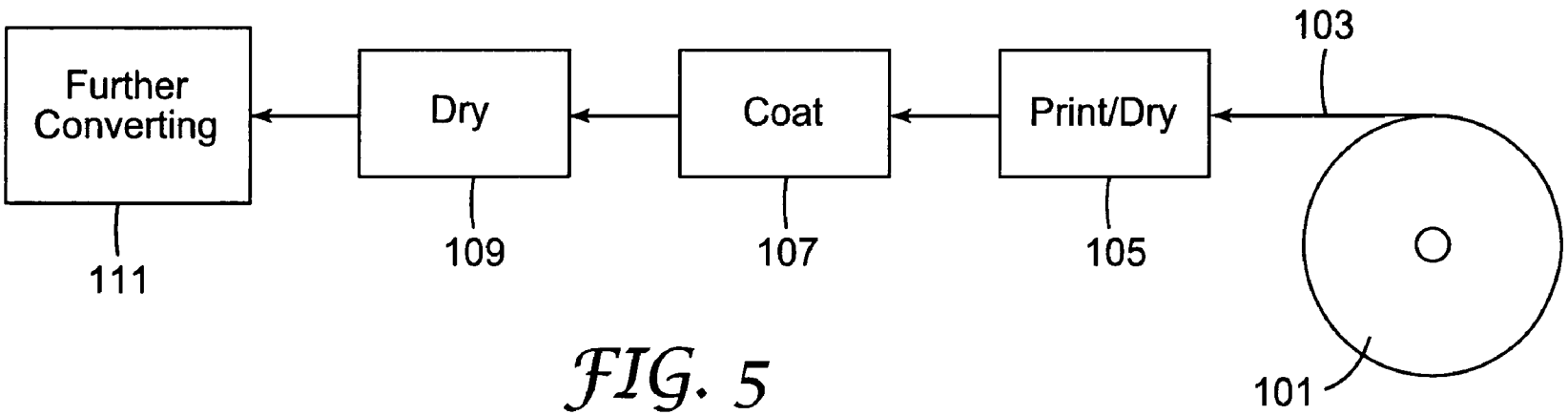
FIG. 5 is a schematic illustration of the inventive coating apparatus of the present invention on a web printing line.

The above described simple means for activating and deactivating the application of coating fluid to a moving web makes the present inventive system readily compatible with an established printing process line for a moving web. FIG. 5 schematically illustrates a web printing line which includes the inventive coating process. A web supply 101 provides a web 103 for movement along a coating path through a plurality of web processing stations 105, 107, 109 and 111. In this exemplary process, web processing station 105 is a printing station wherein indicia is applied to one side of the web 103. The printing station 105 typically includes a dryer, or the web immediately thereafter traverses a drying station. The printed web is then advanced into the inventive coating station 107, wherein a striped pattern of coating fluid such as adhesive is applied to one surface of the web 103. This may be the surface that has already been printed on, or maybe the opposite surface of the web. After the coating pattern has been applied, the web is then advanced to a drying station 109 to dry or cure as necessary the coating which has just been applied. The web 103 is then further advanced to a further converting station 111, which may include additional printing stations, cutting or trimming stations, and the application of another layer of web material (i.e., an adhesive liner), or other further web converting processes to achieve a desired final product. FIG. 5 is merely exemplary of a possible web printing line which would include a coating station 107 embodying the apparatus and method of the present invention. In various embodiments, printing on both sides of the web may occur prior to the coating station 107, or other converting operations may be applied to the moving web prior to the coating station 107. Likewise, further printing on one or both sides of the web, or further converting operations can take place down-web of the coating station 107. In addition, a second coating station which embodies the apparatus and method of the present invention can be provided to coat a secondary pattern of coating fluid on the same side of the web as already coated, or on the opposite side of the web.

The inventive coating system and method described herein, when activated, applies a continuous pattern of stripes of coating fluid to a web (continuous along the length of the web, without interruption). In some instances, it may be desired to apply coating fluid intermittently along the length of the web. This can be accomplished by modifying the impression roll and controlling the distance between the impression roll and applicator roll, in the manner illustrated in FIGS. 6-9.

Figure 6:
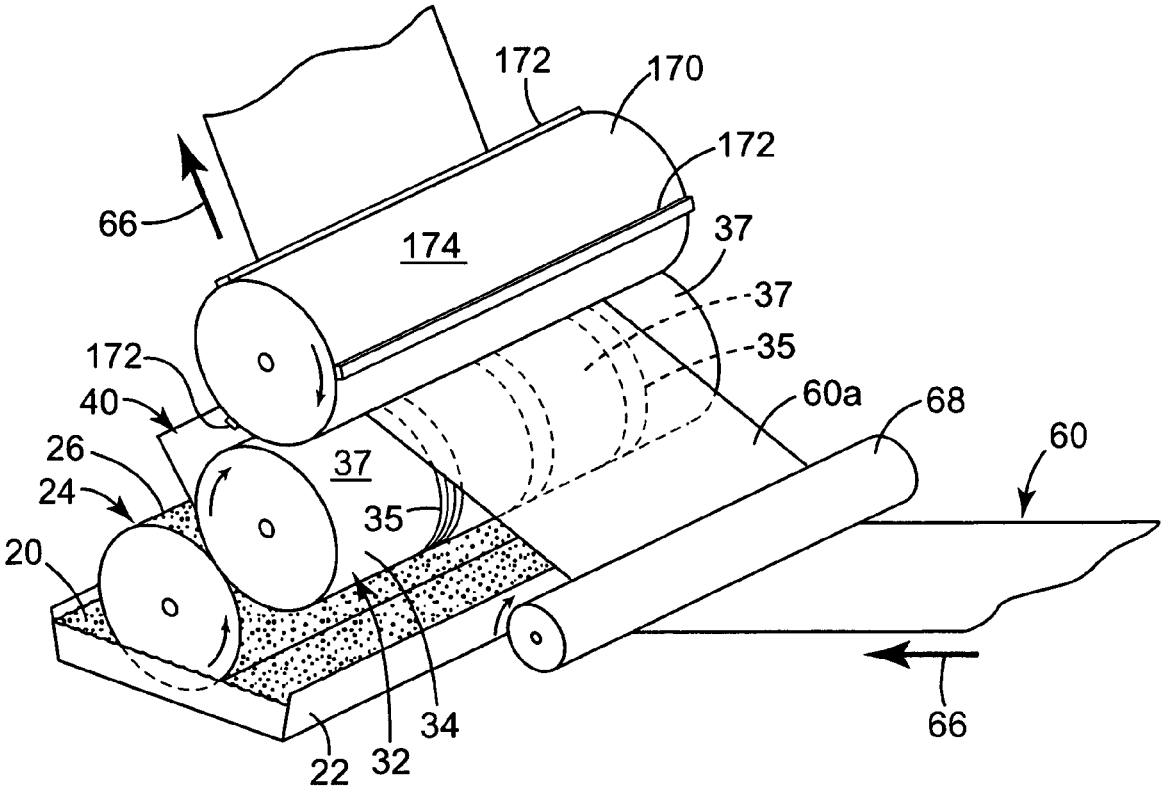
FIG. 6 is a perspective view of an alternative embodiment of a web coating apparatus and method of the present invention, wherein the impression roll has a raised image pattern formed to intermittently bring a moving web into contact with an applicator roll.
Figure 7:
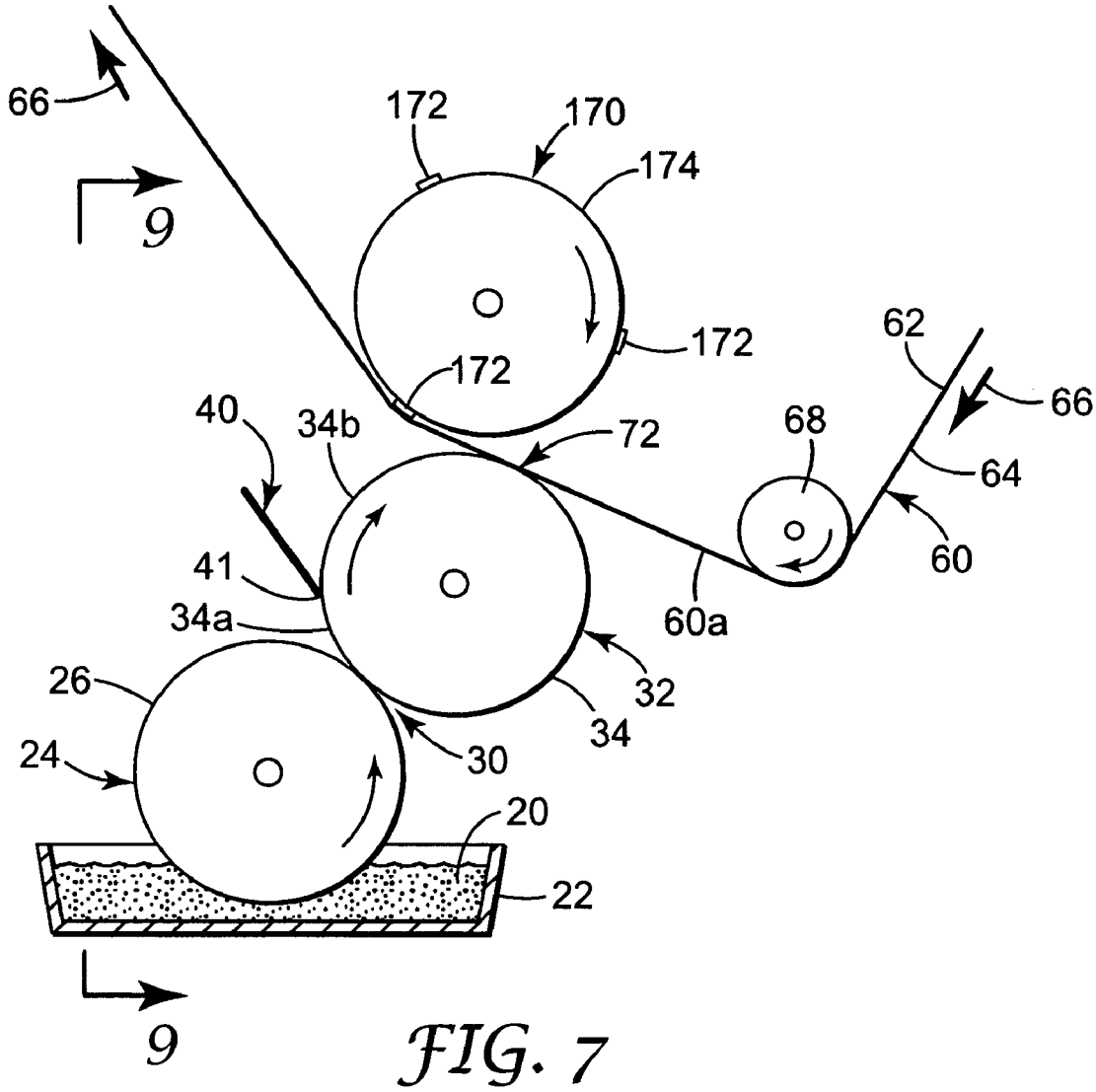
FIG. 7 is a schematic side view of the coating apparatus of FIG. 6, wherein an impression roll is rotated to a position wherein the moving web contacts the applicator roll.
Figure 8:
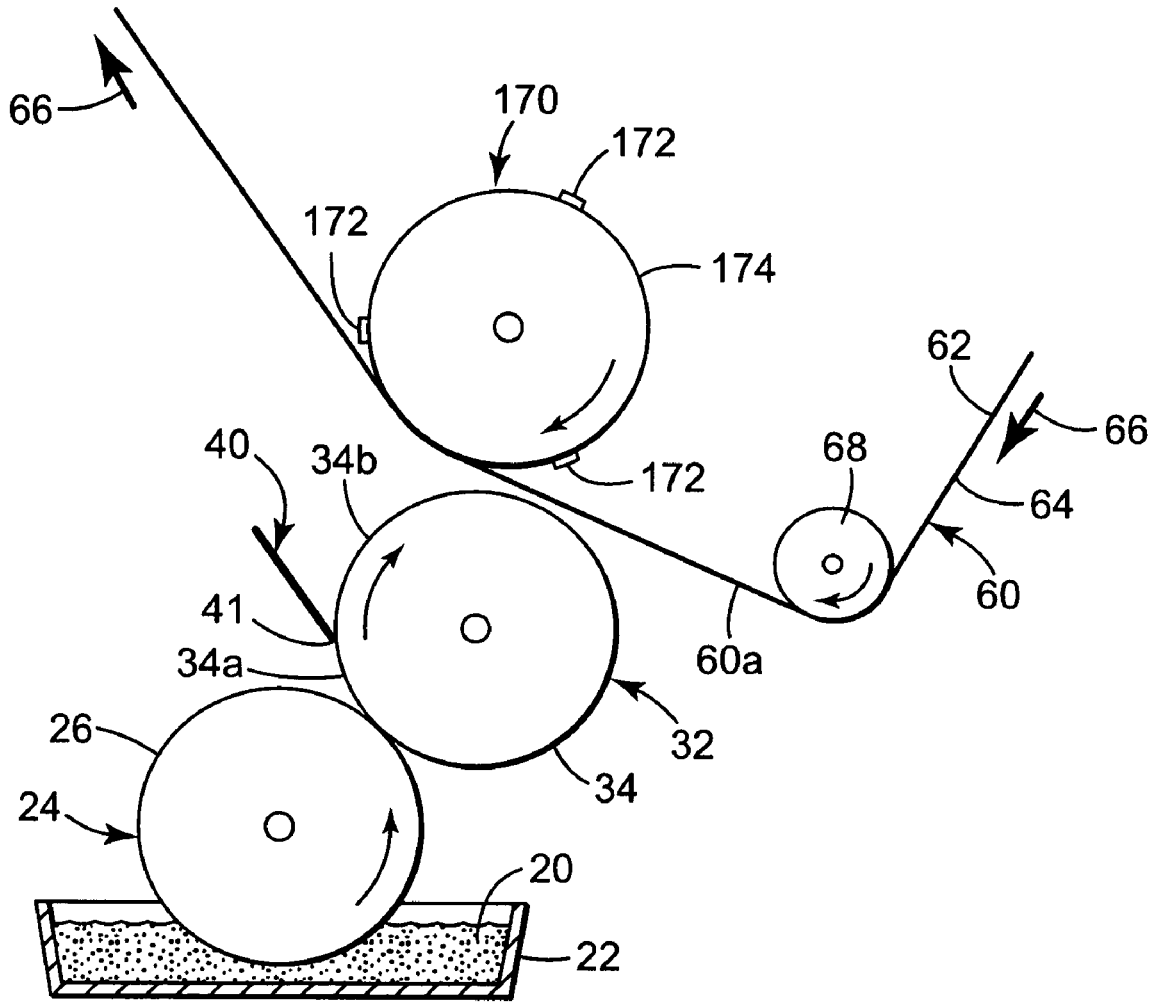
FIG. 8 is a schematic side view of the coating apparatus of FIG. 7, wherein the impression roll is rotated to a position wherein the moving web is spaced from the applicator roll.
Figure 9:
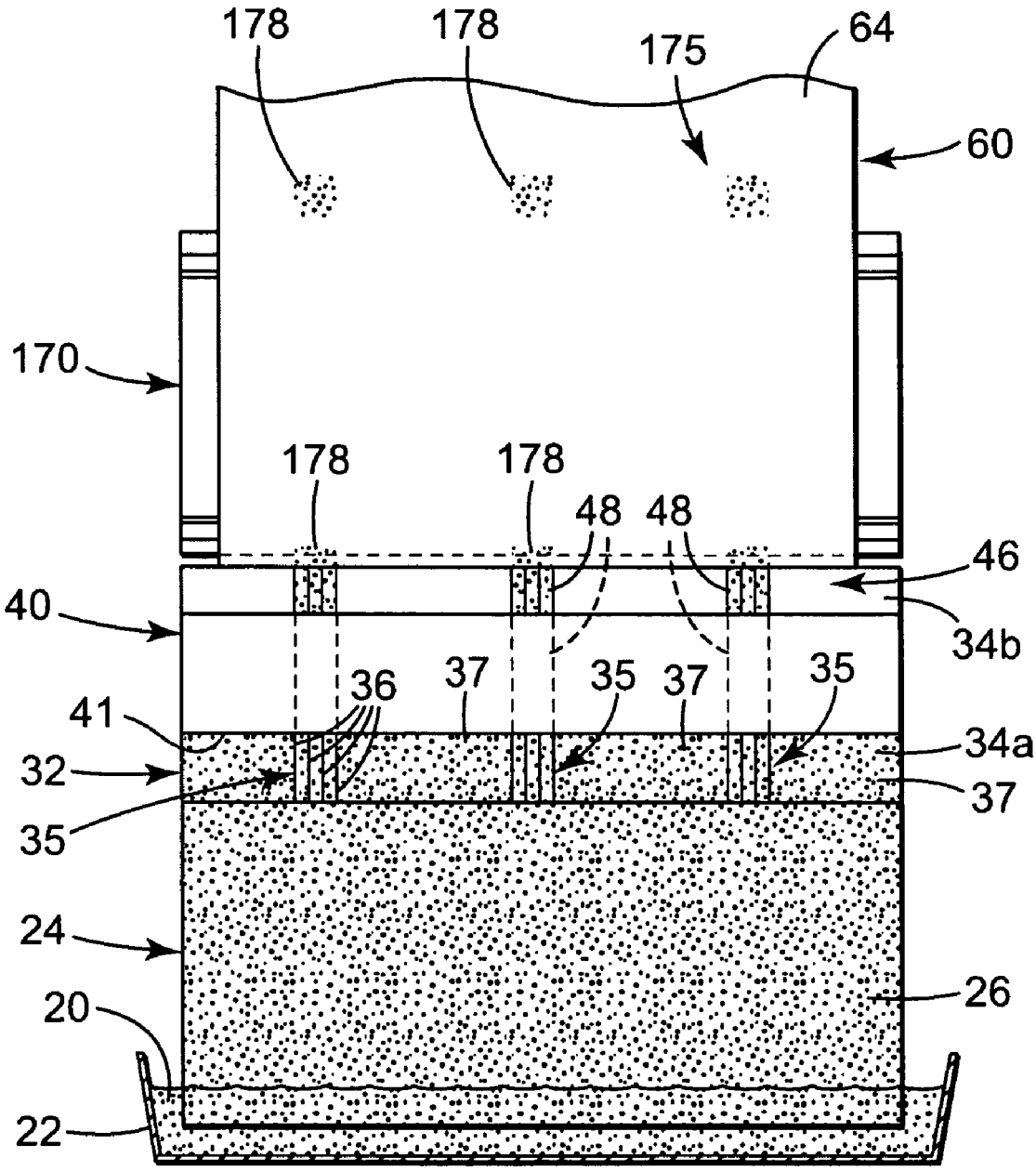
FIG. 9 is a schematic sectional view-as taken along lines 9-9 in FIG. 7.

In the embodiments illustrated in FIGS. 1-4, the impression roll 70 has a generally smooth cylindrical outer surface. The components illustrated in FIGS. 6-9 are the same as illustrated in FIGS. 1-3, except for the configuration of the outer surface of the impression roll. In FIG. 6, rotating impression roll 170 has one or more raised image patterns or cams 172 extending longitudinally across its circumferential surface 174 (parallel to an axis of the impression roll 170). The raised image patterns 172 do not engage the applicator roll surface 34, but during rotation of the impression roll 170, serve to intermittently urge the coating surface 64 of the web 60 into coating fluid transfer contact with the applicator roll surface 34. FIG. 7 illustrates that the coating surface 64 of the web 60 contacts the applicator roll surface 34 when the free span 60*a* of the web 60 extends between the idler roll 68 and one of the raised image patterns 172 on the impression roll 170. FIG. 8 illustrates that the free span 60*a* of the web 60 does not contact the applicator roll surface 34 when it extends between the idler roll 68 and the circumferential surface 174 of the impression roll 170. Only when a raised image pattern 172 engages the top surface 62 of the web 60 and pushes it toward the applicator roll 32 (FIG. 7) does the free span 60*a* of the web 60 engage the post-doctor blade applicator roll surface 34*b*, as at line of contact 72. As explained above, the post-doctor blade applicator roll surface 34*b* bears the pattern 46 of coating fluid 20*a* (e.g., one or more stripes 48 of coating fluid). This pattern is only transferred to the web 60 when the free span 60*a* of the web 60 contacts the post-doctor blade applicator roll surface 34*b* (as caused by intermittently contact of the web 60 with the raised image patterns or cams 172 on the impression roll 170). Accordingly, the coating fluid pattern applied to the coating surface 64 of the web 60 is not continuous along the length of the web, but is intermittently applied as coating pattern 175 (see FIG. 9). Coating pattern 175 thus comprises intermittently applied short stripes of coating fluid 178 on the coating surface 64 of the web 60, as seen in FIG. 9. As can be appreciated, the raised image patterns or cams 172 can take on a variety of forms (e.g., stripes, circles, squares, etc.) to define the intermittent stripes 178 of coating fluid on the web 60. In addition the intermittent stripes 178 may be applied in registry with other images printed (or to be printed) on the web 60.

Figure 10:
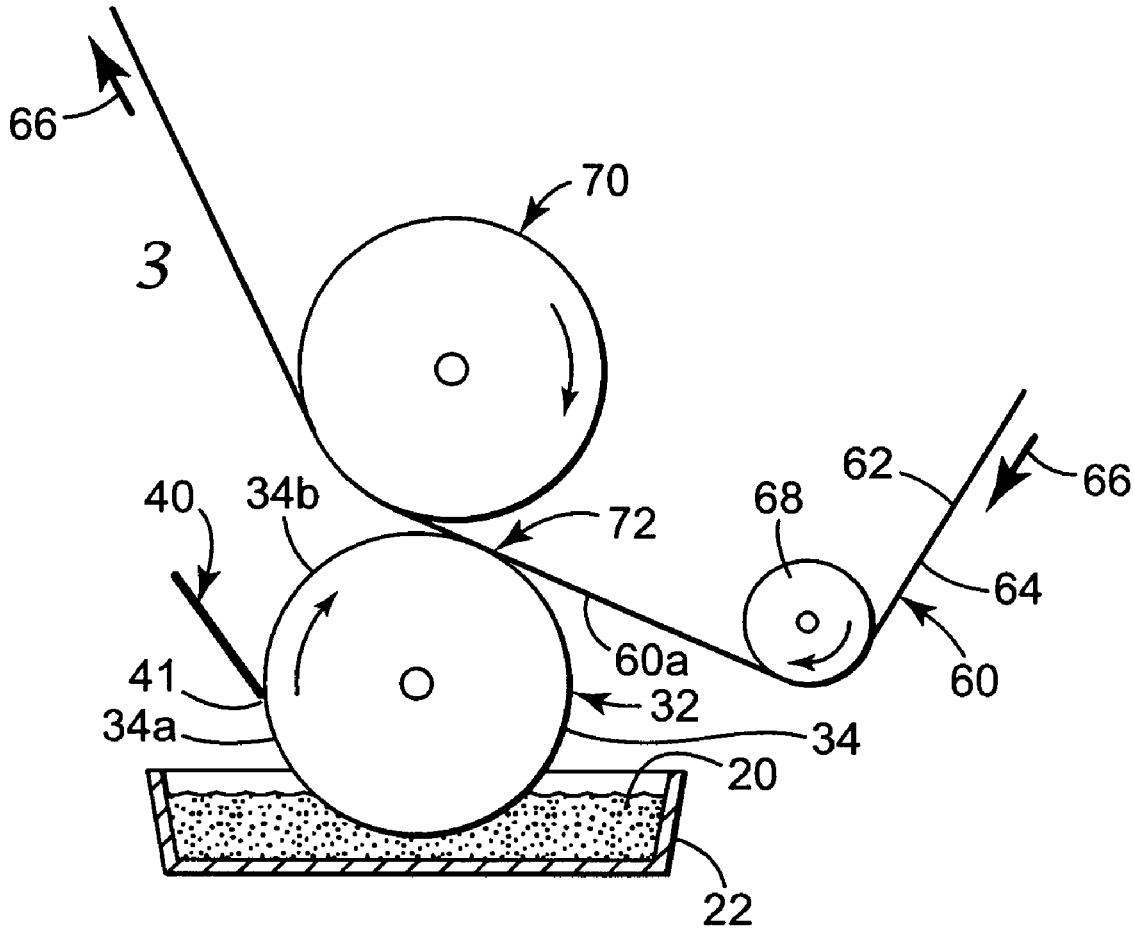
FIG. 10 is a schematic side view of a third alternative embodiment of the web coating apparatus and method of the present invention.

In the embodiments discussed above, coating fluid 20 is delivered to the applicator roll surface 34 by a fountain roll 24. In alternative embodiments of the inventive coating apparatus and method of the present invention, other arrangements for delivering coating fluid to the applicator roll surface are possible. For instance, as seen in FIG. 10, the applicator roll 32 itself may rotate so that a portion thereof contacts coating fluid 20 within a pan 22 under the applicator roll 32. Thus, no fountain roll is provided; rather, the applicator roll 32 itself picks up coating fluid 20 from an underlying pan 22, which is then treated (i.e., metered into stripes on the applicator roll surface) by contacting the doctor blade 40. While the arrangement illustrated in FIG. 10 is simpler (requiring no fountain roll) and may thus reduce foaming of the coating fluid, the act of forcing the coating fluid through a nip between adjacent rolls may serve a useful purpose. Channeling the coating fluid through a nip prior to engaging the doctor blade may serve to reduce the possibility of air bubbles being entrained within the grooves, thus achieving a more uniform coating.

While the apparatus and process of FIG. 10 for delivering coating fluid 20 to the surface 34 of the applicator roll 32 differs from the embodiments described above, the metering of the coating fluid via the topography of the applicator roll surface 34 (e.g., groove portions 35) and the doctor blade 40 serve to achieve a uniform deposition of coating fluid on the post-doctor blade applicator roll surface 34*b*. The alignment of the topography (e.g., groove portions 35 and smooth portions 37) serve to define a desired pattern of coating fluid stripes on the post-doctor blade applicator roll surface 34*b*. That pattern is carried by the applicator roll 32 until it is transferred to the web 60 at the line of contact 72 defined along free span 60*a* of the web 60. The stripes of coating fluid are transferred to the coating surface 64 of the web 60 in the manner described above, in a reverse kiss coating application.

Although the present invention has been described with reference to preferred embodiments, workers skilled in the art will recognize that changes may be made in form and detail without departing from the spirit and scope of the invention. All publications and patents are incorporated herein by reference to the same extent as if each individual publication or patent was specifically and individually indicated to be incorporated by reference. Also incorporated herein by reference is co-assigned U.S. patent application Ser. No. 11/027,511, filed on even date herewith, on "Method and Apparatus of Forming a Coating Fluid Pattern", and published as U.S. Patent Publication No. 2006/0147636.

The invention claimed is:

1. A method for coating a surface with a pattern of coating fluid, the method comprising:

introducing coating fluid containing microspheres onto a surface of an applicator roll, wherein the topography of the applicator roll surface comprises at least one longitudinally extending circumferential, helical groove portion which is sized to at least partially receive the microspheres of the coating fluid therein, and at least one circumferential, longitudinally extending smooth surface portion;

engaging the applicator roll surface with a doctor blade to remove coating fluid from the smooth surface portion thereof and to limit the amount of microspheres advanced past the doctor blade by the helical groove portion of the applicator roll surface, wherein a pattern of coating fluid containing microspheres remains on the applicator roll surface which is defined by the helical groove portion thereon and is formed to define at least one stripe of coating fluid containing microspheres; and transferring the pattern of coating fluid from the applicator roll surface onto a coating surface of a moving web wherein the moving web engages the applicator roll surface in a reverse kiss orientation.

2. The method of claim 1 wherein the introducing step comprises:

applying the coating fluid containing microspheres onto a surface of a fountain roll which is aligned to form a nip with the applicator roll surface, wherein the roll surfaces move in opposite directions; and transferring the coating fluid from the fountain roll surface onto the applicator roll surface at the nip.

3. The method of claim 1 wherein the helical groove portion includes a helical groove aligned at an angle of about 80 degrees to about 90 degrees relative to an axis of the applicator roll.

4. The method of claim 1 wherein the selected size for the microspheres is from about 5 to about 200 microns in diameter.

5. The method of claim 1 wherein the helical groove portion includes a helical groove having a depth of about 50 to about 300 microns, and is disposed at about 40 to about 300 grooves per inch across the applicator roll surface.

6. The method of claim 1 wherein the helical groove portion includes a V-shaped helical groove having a tooth angle of about 15 to about 120 degrees.

7. The method of claim 1, and further comprising:

selectively engaging the coating surface of the moving web with the applicator roll surface bearing the pattern of coating fluid.

8. The method of claim 7, wherein the selectively engaging step comprises:

moving an impression roll over which the moving web traverses toward the applicator roll until the coating surface of the moving web contacts the applicator roll surface bearing the pattern of coating fluid.

9. The method of claim 8, wherein the impression roll has a raised image pattern extending longitudinally across a circumferential surface thereof, and further comprising:

as the impression roll is rotated and the moving web passes thereby, selectively engaging the rear surface of the moving web with the raised image pattern to urge the coating surface of the moving web into intermittent engagement with the pattern of coating fluid on the applicator roll, thereby intermittently transferring coating fluid from the applicator roll surface to the moving web.

10. The method of claim 1 wherein the topography of the applicator roll surface comprises a plurality of said groove portions and smooth portions, with longitudinally adjacent groove portions spaced apart by one of said smooth portions, wherein the pattern of coating fluid containing microspheres is defined by a plurality of stripes of coating fluid.

11. The method of claim 1 wherein the applicator roll surface is non-conformable.

12. The method of claim 1, and further comprising:

advancing the moving web past a drying station to fix the pattern of coating fluid thereon.

13. The method of claim 1, and further comprising:

advancing the moving web past a printing station for printing indicia on one or more of the surfaces of the moving web.

14. The method of claim 1, and further comprising:

moving the applicator roll surface at a first speed; and advancing the moving web past the applicator roll surface at a second speed which is slower than the first speed.

15. A method of applying a coating fluid containing microspheres onto a moving web having a coating surface and an opposed rear surface, wherein the method comprises:

applying a coating fluid containing microspheres onto a rotating fountain roll surface having a longitudinal extent wherein the microspheres of the coating fluid range in size from about 5 to about 200 microns in diameter;

transferring the coating fluid from the fountain roll surface onto a rotating applicator roll surface having a longitudinal extent, wherein a topography of the applicator roll surface comprises at least one longitudinally extending circumferential, helical groove portion which is shaped for reception of the microspheres of the coating fluid therein wherein the helical groove portion includes a helical groove having a depth of about 50 to about 300 microns, and is disposed at about 40 to about 300 grooves per inch across the applicator roll surface and at least one circumferential, longitudinally extending smooth surface portion;

engaging the applicator roll surface with a linear doctor blade edge to remove coating fluid from the smooth surface portion of the applicator roll surface and to limit the amount of microspheres advanced past the doctor blade edge by the helical groove portion of the applicator roll surface, wherein a pattern of coating fluid containing microspheres remains on the applicator roll surface which is defined by the helical groove portion thereon and is formed to define at least one stripe of coating fluid containing microspheres; and transferring the stripe of coating fluid containing microspheres from the applicator roll surface onto the coating surface of a moving web wherein the web is moved past the applicator roll in a reverse kiss orientation.

16. The method of claim 15 wherein the helical groove portion includes a helical groove aligned at an angle of about 80 degrees to about 90 degrees relative to a longitudinal axis of the applicator roll.

17. The method of claim 15 wherein the helical groove portion includes a helical V-shaped groove having a tooth angle of about 15 to about 120 degrees.

18. The method of claim 15, and further comprising:

selectively engaging the coating surface of the moving web with the applicator roll surface bearing the pattern of coating fluid.

19. The method of claim 18, wherein the selectively engaging step comprises:

moving an impression roll over which the moving web traverses toward the applicator roll until the coating surface of the moving web contacts the applicator roll surface bearing the pattern of coating fluid.

20. The method of claim 19, wherein the impression roll has a raised image pattern extending longitudinally across a circumferential surface thereof, and further comprising:

as the impression roll is rotated and the web passes thereby, selectively engaging the rear surface of the moving web with the raised image pattern to urge the coating surface of the moving web into intermittent engagement with the pattern of coating fluid on the applicator roll, thereby intermittently transferring coating fluid from the applicator roll surface to the moving web.

21. The method of claim 15, wherein the applicator roll surface comprises a plurality of circumferential helical groove portions, spaced apart longitudinally by circumferential smooth surface portions therebetween, wherein each helical groove portion is shaped for reception of the microspheres of the coating fluid therein, and wherein the pattern of coating fluid containing microspheres is formed to define a like plurality of stripes of coating fluid containing microspheres.

22. The method of claim 15 wherein the applicator roll surface is non-conformable.

23. The method of claim 15, and further comprising:

advancing the moving web past a drying station to fix the pattern of coating fluid containing microspheres thereon.

24. The method of claim 15, and further comprising:

advancing the moving web past a printing station for printing indicia on one or more of the surfaces of the moving web.

25. The method of claim 15, and further comprising:

reciprocating the linear doctor blade edge longitudinally back and forth across the applicator roll surface.

* * * * *

UNITED STATES PATENT AND TRADEMARK OFFICE

CERTIFICATE OF CORRECTION

PATENT NO. : 7,625,605 B2
APPLICATION NO. : 11/027542
DATED : December 1, 2009
INVENTOR(S) : Cooprider et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1010 days.

Signed and Sealed this

Second Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,625,605 B2
APPLICATION NO. : 11/027542
DATED : December 1, 2009
INVENTOR(S) : Terrence Eugene Cooprider et al.

It is certified that error appears in the above-identified patent and that said Letters Patent is hereby corrected as shown below:

Column 6
Line 57; Delete "uniformed" and insert -- uniform --, therefor.

Column 11
Line 31; Delete "therein wherein" and insert -- therein, wherein --, therefor.

Signed and Sealed this
Twenty-seventh Day of November, 2012

David J. Kappos

David J. Kappos
*Director of the United States Patent and Trademark Office*